US008911176B2

(12) United States Patent
Jones

(10) Patent No.: US 8,911,176 B2
(45) Date of Patent: Dec. 16, 2014

(54) SUBSEA CRUDE OIL AND/OR GAS CONTAINMENT AND RECOVERY SYSTEM AND METHOD

(76) Inventor: Robert H. Jones, Stouffiville (CA)

( * ) Notice: Subject to any disclaimer, the term of this patent is extended or adjusted under 35 U.S.C. 154(b) by 0 days.

(21) Appl. No.: 13/983,384

(22) PCT Filed: Feb. 4, 2011

(86) PCT No.: PCT/CA2011/000136

§ 371 (c)(1),
(2), (4) Date: Oct. 3, 2013

(87) PCT Pub. No.: WO2012/103623

PCT Pub. Date: Aug. 9, 2012

(65) Prior Publication Data

US 2014/0017010 A1 Jan. 16, 2014

(51) Int. Cl.

| | |
|---|---|
| ***E02B 15/04*** | (2006.01) |
| ***E21B 43/01*** | (2006.01) |
| ***B63B 35/32*** | (2006.01) |

(52) U.S. Cl.

CPC ..... *E21B 43/0122* (2013.01); *B63B 35/32* (2013.01)

USPC ..... 405/60

(58) Field of Classification Search

USPC ..... 405/60, 64

See application file for complete search history.

(56) References Cited

U.S. PATENT DOCUMENTS

| | | | | |
|---|---|---|---|---|
| 1,830,061 | A * | 11/1931 | Howe | 405/60 |
| 3,339,512 | A | 9/1967 | Siegel | |
| 3,548,605 | A * | 12/1970 | Armistead et al. | 405/60 |
| 3,561,220 | A * | 2/1971 | Riester | 405/60 |
| 3,658,181 | A | 4/1972 | Blair | |
| 3,902,553 | A | 9/1975 | Jergins | |
| 4,358,219 | A * | 11/1982 | Burns | 405/60 |
| 4,395,157 | A * | 7/1983 | Cunningham | 405/60 |
| 4,449,850 | A * | 5/1984 | Cessou et al. | 405/60 |
| 8,173,012 | B1 * | 5/2012 | Che | 405/60 |
| 8,678,708 | B2 * | 3/2014 | Bond et al. | 405/60 |
| 2005/0025574 | A1 | 2/2005 | Lazes | |
| 2011/0318106 | A1 * | 12/2011 | Gateff et al. | 405/60 |

FOREIGN PATENT DOCUMENTS

| | | |
|---|---|---|
| FR | 2804935 | 8/2001 |
| WO | 82/01387 | 4/1982 |
| WO | 93/11305 | 6/1993 |

OTHER PUBLICATIONS

Search Report and Written Opinion mailed Oct. 17, 2011 in international application No. PCT/CA2011/000136, 6 pgs.

* cited by examiner

*Primary Examiner* — Frederick L Lagman
(74) *Attorney, Agent, or Firm* — Fish & Richardson P.C.

(57) ABSTRACT

A system and a method to contain and recover crude oil and/or gas from a leaking wellhead on a sea bed is described. The system broadly consists of a series of elongated tubes positioned vertically from the sea floor and enclosing the wellhead and rising to the sea surface to be recovered. The leaking crude oil and/or gas rises is contained in the elongated tubes and rises through the series of elongated tubes to sea surface for recovery. Recovery of the crude oil and/or gas on the sea surface is carried out by any of the means currently applicable for this purpose. The method describes how to deploy the crude oil and/or gas containment and recovery system.

20 Claims, 3 Drawing Sheets

SUBSEA CRUDE OIL AND/OR GAS CONTAINMENT AND RECOVERY SYSTEM AND METHOD

This application is a U.S. National Phase Application under 35 U.S.C. §371 of International Patent Application no. PCT/CA20111/000136, filed on Feb. 4, 2011, the entire contents of which are hereby incorporated by reference.

FIELD OF THE INVENTION

The present invention relates to offshore crude oil and/or gas drilling industries. In particular, the present invention relates to a system and a method for the containment and recovery of crude oil and/or gas from the well opening on the seabed when an offshore platform/rig suffers a failure and the well is leaking crude oil and/or gas uncontrollably.

BACKGROUND OF THE INVENTION

As dry land deposits of crude oil and/or gas become scarcer, the exploration and development of offshore resources has become a major multi-billion dollar industry.

On Apr. 20, 2010, the Deepwater Horizon (an ultra-deep-water offshore drilling platform/rig) was drilling at the Macondo Prospect when an explosion on the rig caused by a blowout from a high pressure gas pocket killed 11 crewmen and ignited a fireball visible from 56 km away. The resulting fire could not be extinguished and, on Apr. 22, 2010, the Deepwater Horizon sank, leaving the wellhead gushing at the sea floor and causing the largest offshore oil spill in United States history. The Macondo Prospect is an oil and gas prospect in the United States Exclusive Economic Zone of the Gulf of Mexico and located approximately off the coast of Louisiana 60 kilometers (kms) off the shores of Louisiana. The oil spill caused catastrophic environmental damage to marine life and habitat of the coastal marshes along the Gulf Coast, which are the breeding grounds and migratory destination of many species of birds and insects. It has been estimated that a total of approximately 5 million barrels of oil was discharged between the start of the leak on Apr. 20 and eventual capping of the leak on Jul. 15. The environmental and ecological effects are significant and of global importance. These types on incidences may become more common as the offshore industry grows.

With the above in mind, it should be noted that most new crude oil and/or gas developments have been directed to obtaining crude oil and/or gas from deposits beneath the sea bed, sometimes at considerable depths in excess of 1 km below sea level, at these depths water pressure is an important factor to consider and overcome. The Deepwater Horizon was drilling in an area that was approximately 1.5 km below sea level.

Pressure is the force per unit area applied in a direction perpendicular to the surface of an object, a common metric unit for pressure is the Pascal (Pa) and has units of Newton per meters square ($N/m^2$). Water pressure increases linearly with depth at a rate of approximately 10 kPa per vertical meter of water. At a depth of 1 km, water pressure reaches approximately 10 Megapascal (MPa), this is approximately 100 times greater the atmospheric pressure at sea level.

It becomes obvious that when incidents such as the Deepwater Horizon explosion and resultant oil spill as described above occurs at these depths, where extremely high water pressures and no light exist, repairs present an almost insurmountable challenge and likely cannot be accomplished. There are, in reality, only two viable options. The first option is to plug the leak, again being very difficult given the extreme water pressure and lack of light. The preferable second option is to contain and direct the oil spewing from the well to the sea surface for capture and recovery.

In the past, attempts have been made to provide a system, an apparatus or a method for containing and/or trapping crude oil/or gas from an offshore well blowout for recovery. However, these attempts have shown to have some deficiencies and are briefly discussed herein below.

U.S. Pat. No. 3,481,294 to Vincent dated Dec. 2, 1969 describes an anchoring system for a drilling vessel, the system including a large diameter vertical pipe, i.e., a riser pipe. The riser pipe is provided with an anchoring system and a chamber contains anchor winches whose cables are connected to anchors in the ocean floor at points surrounding the riser pipe. The anchoring system is made sufficiently strong to moor not only the riser pipe but also a drilling vessel. The drilling vessel is connected to the vertical pipe by a unique system so that the vessel is able to 'weathervane' around the pipe. A drawback of the system of Vincent is that it does not propose a system or method for containing an oil spill.

United Kingdom Patent Application No. 2,002,839 to Kovacs dated Feb. 28, 1979 describes a system for confining and controlling a blow-out on oil drilling or production rigs. In order to collect the oil discharged during a blow-out a deflector screen is provided over the derrick, which screen is constructed to direct the oil stream into a collecting basin, which is separated from the main work site. Thereby there will be sufficient time for the working personnel to get away and to activate shut off valves. A shelter 3 in direct communication with the main work site on the rig is provided. A drawback of system of Kovacs is that it does not propose a system or method that is portable or that contains and directs crude oil and/or gas from the leak source to the sea surface.

U.S. Pat. No. 4,318,442 to Lunde, et al. dated Mar. 9, 1982 describes an apparatus for controlling an underwater well blowout including a vessel with a lower weighted collar vent ports intermediate the top and bottom of the vessel a valve controlled chimney at the top of the vessel, a gas outlet positioned to provide a gas cap in the vessel when the valve is closed with the vessel in position around the blowing well, an oil outlet above the vent ports and below the gas cap and means for pumping substantially only oil from the vessel at a rate to prevent oil from escaping from the vessel to the sea in substantial quantities. The method includes the steps of lowering a vessel with a weighted collar, a frustoconical upper section, a valve controlled chimney leading from the upper section, vent parts, an oil outlet above the vent ports and a gas outlet providing a gas cap, over an underwater blowing well with the chimney valve open, seating the vessel on the bottom around and over the blowing well, pumping substantially only oil including entrained gas from the oil outlet and conducting free gas away from the vessel. A drawback of the method and apparatus of Lunde is that it installation of a bulky apparatus at the site of the leak on the sea bed; this may prove to be difficult, especially at extreme depths.

U.S. Pat. No. 4,416,565 to Ostlund dated Nov. 22, 1983 describes a method by collection and separation of oil, gas and water from an offshore oil/gas well and a column for usage by the same. The column comprising a vertically arranged tube with a lower end resting on the sea bed and an upper closed end from which gas may be discharged by gas outlet means. Oil-gas mixture flowing out of a well head in operation of the column will be retarded by an oil column in the tube, thereby releasing gas which is collected in the upper portion of the column. Motion of the oil at the surface of the oil column will be very small, oil thereby flowing over an overflow rim into an overflow channel, from where oil is transferred to the sea surface by oil outlet means. The motion of the mixture may be additionally dampened by horizontal webs. The column may be operated at sea depths more than 300 meters and at shallow water where the column may be constructed as part of a platform. A drawback of the method and column of Ostlund is that it requires installation of a complex apparatus at the site of the leak on the sea bed; this may prove to be difficult, especially at extreme depths.

U.S. Pat. No. 4,456,071 to Milgram dated Jun. 26, 1984 describes a collector apparatus and collection method for use with a blown-out seabottom wellhead. The collector apparatus, including a collector element with an extended, open base and an upper portion enclosing a volume to receive fluid (substantial quantities of gas and lesser quantities of oil) rising, in the water, from the wellhead, and a riser connected to the collector element and extending thereabove to conduct fluid therefrom, is characterized in that the collector element is adapted for fixable attachment to the ocean floor about the seabottom well head prior to any blow-out, and the upper portion of the collector element further includes a relief passage from its interior to the exterior of the collector apparatus, the release passage adapted to vent excess gas from the collector apparatus during initial stages of any blow-out. In preferred embodiments, the relief passage is valved to allow the passage to be closed after the initial stages of any blow-out to limit escape of released oil and reduce the amount of water collected and the collector includes a drilling port adapted to allow drilling operations to proceed therethrough. A drawback of the collector apparatus of Milgram is that it requires installation over the wellhead and affixed to the seabed prior to a blowout.

U.S. Pat. No. 4,323,118 to Bergmann dated Apr. 6, 1982 teaches an apparatus for controlling and preventing an oil blowout comprising a hollow frustoconical dome which is disposable over the end of a well discharge pipe or an offshore rig discharge pipe. At the top of the hollow dome is an axially disposed main valve for the blowoff of oil or gas escaping from the discharge pipe. A plurality of concentrically disposed two-way valves are disposed at the top of the dome about the main valve. With the main valve and the concentrically disposed valves open for the blow off of liquids and fluids, the dome is lowered over the discharge pipe. When the dome is fully lowered, it seats on the bottom surface surrounding the outlet of the discharge pipe. Concrete is poured around the dome to seal the dome to the bottom surface. Connected to the concentrically disposed valves are conduits for conducting gas and oil escaping from the discharge pipe to a storage facility, such as a barge, tank or the like, when the concentrically disposed valves are open for storing oil or gas. Flexible cables are connected to the concentrically disposed valves for opening and closing the same from remote locations. In the event of a fire, the concentrically disposed valves are selectively closed in the fire zones to shut off a supply of fuel to the fire in the fire zones. A drawback of the apparatus of Bergmann is that it requires installation of a complex apparatus at the site of the wellhead on the sea bed; this may prove to be difficult, especially at extreme depths.

U.S. Pat. No. 4,382,716 to Miller dated May 10, 1983 describes a blowout recovery vehicle for recovering the discharge from underwater wells comprises a large inverted entrapment shell positionable over a well and having overly extending tubes connected by hose means to surface separation and storage equipment. Floatation tanks are connected to the surface by air lines which are actuated to adjust the buoyancy of the device to raise or lower it so that it can be lowered over a well to trap the discharge from the well. In use, the assembled device can be towed by a tug into position or can be assembled in the water at the site and lowered over the well without the necessity of the tug coming into the effluent discharge area above the well. Alternatively, an anchor can be placed in the seabed directly upstream of the well at some distance from the well. The device can be tied to the anchor by a tow line of exact length equal to the distance between the well and the anchor and positioned either to the right or left of the well so that the force of the current will cause the device to swing about the anchor so that guidance from a surface vessel can position the device over the well. A drawback of the system of Miller is that it requires installation of a complex system at the site of the wellhead on the sea bed; this may prove to be difficult, especially at extreme depths.

U.S. Pat. No. 4,417,624 to Gockel dated Nov. 29, 1983 describes a method and apparatus for controlling the flow of fluids from an open well bore, fluidly communicating the surface and a subterranean formation, the apparatus comprising (a) a slideable base; (b) a support positioned on the base; (c) a pipe engaging device positioned on the support above the base to urge a pipe into the open well bore; and, (d) a pipe straightener positioned on the support means to engage the pipe and straighten it above the well bore. A method for using the apparatus of the present invention is also disclosed. A drawback of the method and apparatus of Gockel is that it requires installation of a complex apparatus at the site of the wellhead on the sea bed; this may prove to be difficult, especially at extreme depths.

U.S. Pat. No. 4,568,220 to Hickey dated Feb. 4, 1986 describes a system and a method for controlling and/or capping undersea oil or gas well blowouts are disclosed. The system includes a mound and a road bed prepared about and leading to an undersea well head, a base plate having an anchoring track and secured onto the mound and about the well head, a collar member secured to the base plate above the well head by being connected to the anchoring track thereof, a structure also erected on the base plate adjacent the well head, a capping member secured to the structure, a bag floating on the sea surface above the well head and a flexible hose connected between the collar member and the bag. Preferably, at least portions of the mound and the road bed are formed on shore of a plurality of preformed segments, then transported to and assembled in situ on the sea floor about the well head. Preferably, a remotely controlled device is provided designed to do work about the well head and accommodated on the road bed leading to the well head. A drawback of the system and method of Hickey is that it requires installation of a complex system at the site of the wellhead on the sea bed; this may prove to be difficult, especially at extreme depths.

The prior art described above does not envisage or indeed teach a Subsea Crude Oil and/or Gas Recovery and Trapping System and Method that:

1. Is easily deployable;
2. Does not require installing a complex apparatus or system over the wellhead on the sea bed;
3. Directs the leaking crude oil and/or gas to manageable area on the sea surface; and
4. Contains the leak to minimize negative environmental effects.

The present invention was conceived and developed having regard to the known prior art and with the purpose of providing a Subsea Crude Oil and/or Gas Containment and Recovery System and Method.

SUMMARY OF THE INVENTION

The present invention provides an easily deployable subsea crude oil and/or gas containment and recovery system and related method.

Accordingly, as an aspect of the present invention, there is provided a subsea crude oil and/or gas containment and recovery system. The system comprises an anchoring means for providing a stable support structure for the system. Guide cables are releasably affixed to the anchoring means by way of guide cable connectors and are used for orienting and/or aligning and supporting the system. A guide cable hoisting means is used for lowering the anchoring means by way of the guide cables. Transfer sections are releaseably and slideably connected to the guide cables by way of cable guiding rings and are used for containing and directing crude oil and/or gas from a wellhead or a crude oil and/or gas leak on a seabed floor. A transfer section hoisting means is used for lowering the transfer sections along the guide cable by way of a hoisting cable.

As another aspect of the present invention, there is provided a method of deploying a subsea crude oil and/or gas containment and recovery system. The method comprises the steps of locating a location of a wellhead or a crude oil and/or gas leak on a seabed floor by way of a locating means. Lowering an anchoring means in a substantially level manner with respect to the seabed floor to the seabed floor encircling the wellhead or the crude oil and/or gas leak by way of a guide cable hoisting means and guide cables into an anchoring position. Tensioning the guide cables by way of a load control system that controls the guide cable hoisting means. Securing a transfer section to the guide cables by way of guide cable connectors. Lowering the transfer section by way of a transfer section hoisting means along the guide cables until it comes to rest on the anchoring means. Securing and lowering subsequent transfer sections until a substantially vertical column of transfer sections are stacked to reach a sea surface. Recovering the crude oil and/or gas from the wellhead or the crude oil and/or gas leak that is being contained and directed to the sea surface by the substantially vertical column of transfer sections.

BRIEF DESCRIPTION OF THE DRAWINGS

Embodiments of the present invention will be further described, by way of example, with reference to the accompanying drawings, in which.

DETAILED DESCRIPTION OF A PREFERRED EMBODIMENT

The following description is presented to enable a person skilled in the art or science to which the present invention pertains to make and use the invention, and is provided in the context of a particular application and its requirements.

A general idea of the Subsea crude oil and/or gas containment and recovery system and method is to provide a piping system to contain the oil leaking out of a wellhead on the seabed and direct it to the sea surface in a controlled fashion. The bottom of the piping system would encircle the leaking wellhead forcing the leaking crude oil and/or gas to be contained within it and direct it upwards along the piping system.

The description herein below refers to FIGS. 1 to 5.

Figure 1:
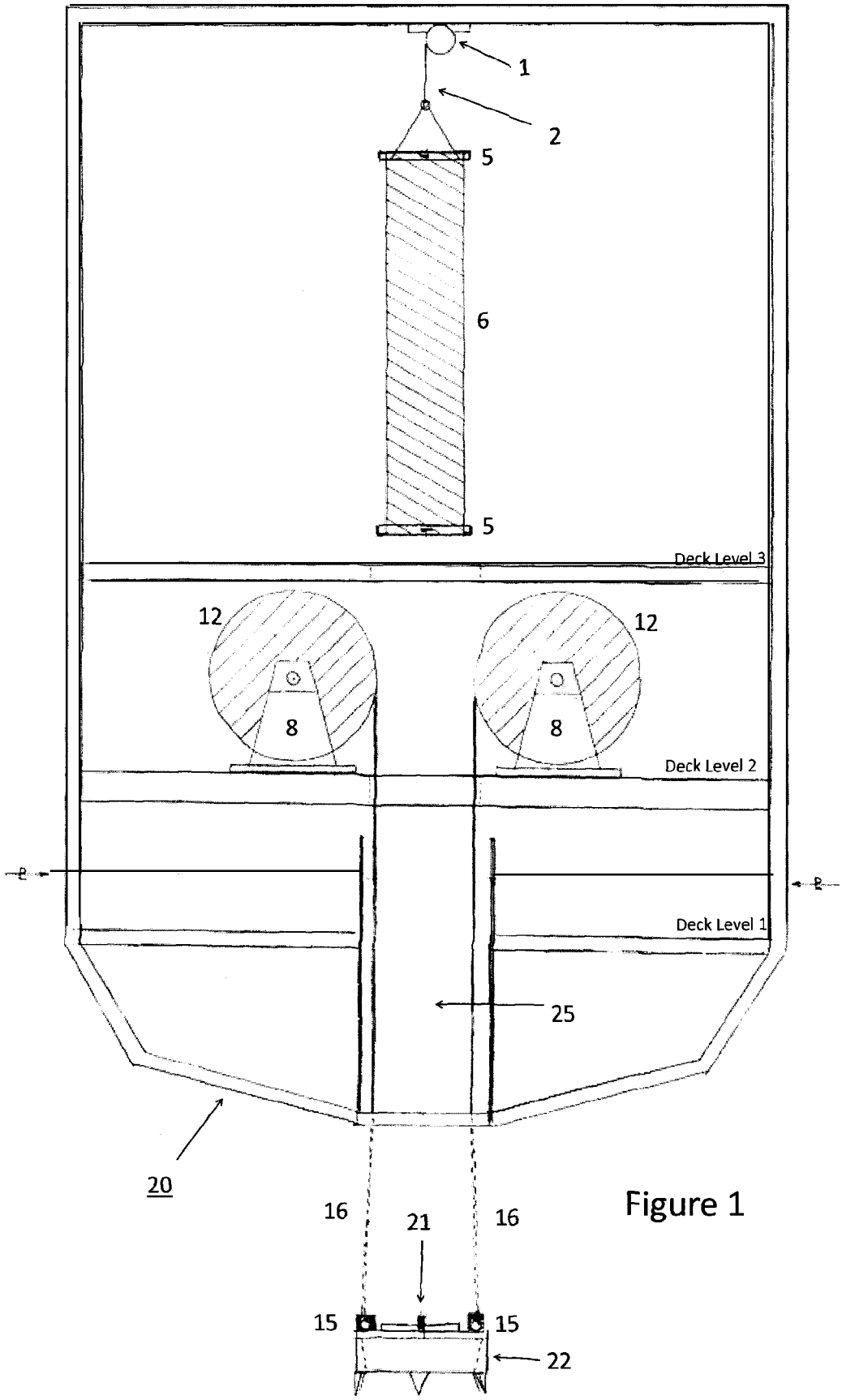
FIG. 1 is a cross-sectional view approximately mid-ship of a vessel modified for use with an embodiment of the present invention.
Figure 2:
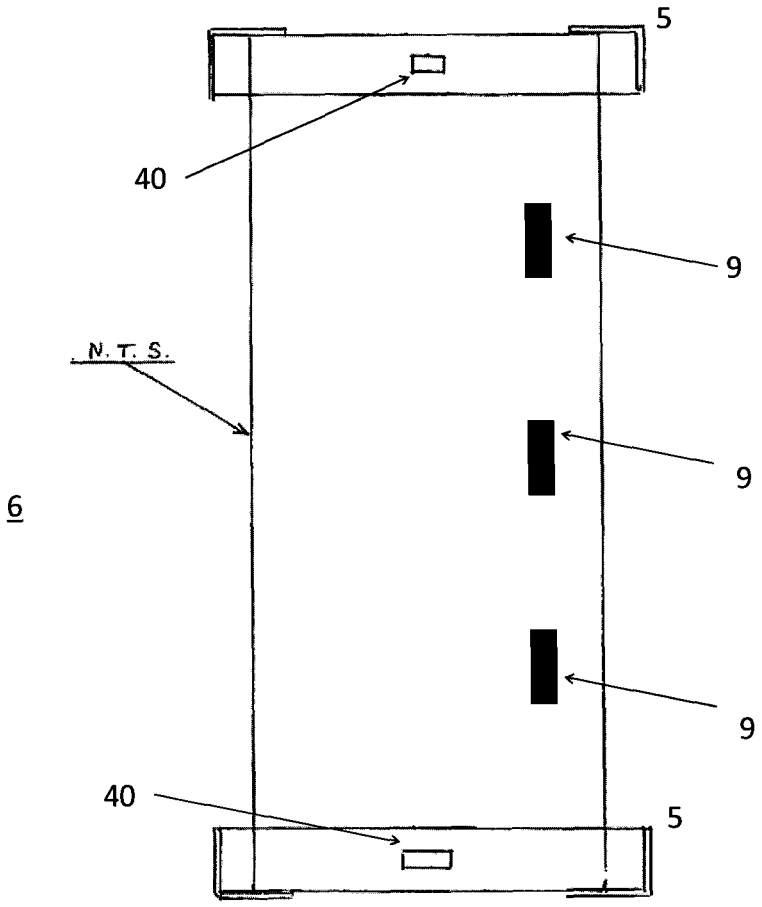
FIG. 2 is a side view of a transfer pipe according to an embodiment of the present invention.
Figure 3:
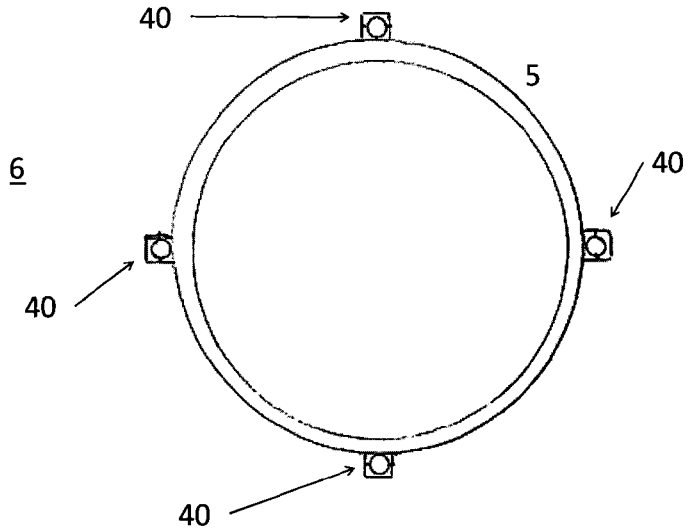
FIG. 3 is a top view of a transfer pipe according to an embodiment of the present invention.

FIG. 1 shows a cross-sectional view mid-ship of a vessel (20) modified for use with the Subsea crude oil and/or gas recovery and trapping system and method. The system broadly comprises an anchoring means (22), guide cable hoisting means (8), guide cables (16), guide cable reels (12), transfer sections (6), and a transfer section hoisting means (1).

The anchoring means (22) is preferably a heavy annular ring dimensioned to encircle a wellhead on the seabed floor and is purposed to give a stable support structure for supporting the transfer sections (6). A rigidly affixed annular ring with base gasket (21) is provided on an upper side of the anchoring means (22) and the inner diameter of the annular ring accommodates the outer diameter of the transfer section. Rigidly affixed cable connectors (15) are provided and evenly distributed proximate the outer edge on the upper side of the anchoring means (22). Preferably, the anchoring means (22) also has protrusions on a bottom side so as to inhibit lateral movement when in an anchoring position. The base gasket (21) is purposed for providing connection means to a gasket of a transfer section (6).

The guide cable hoisting means (8) are used to lower the anchoring means (22) into position on the seabed floor via the guide cables (16) stored on the guide cable reels (12). The guide cables (16) are releasably affixed to the anchoring means (22) via guide cable connectors (15) and are of a sufficient length to at least reach the seabed floor, such as, for example, 1.5 km in length. The guide cables (16) are purposed to ensure that the transfer sections (6) come to rest on the anchoring means (22) or another transfer section (6) in the proper orientation.

The transfer sections (6) are preferably elongated hollow tubes having a flange (5) at each end for connection to a flange of the anchoring means (22) or of another transfer section (6). Preferably, the transfer sections (6) also have a set of cable guiding rings (40), even more preferable, the transfer sections (6) have two sets of cable guiding rings (40) located at each end thereof. Additionally, the transfer sections may be of a different geometric shape, such as, for example, elongated square tubes or elongated oval tubes. Preferably, the transfer sections (6) are standardized in that each of the transfer sections (6) are identical, providing for an easier deployment.

Preferably, the transfer sections (6) are of a hollow double-wall construction. Constructing the transfer sections (6) in this fashion will increase the overall water displacement and lower its submerged displacement mass when compared with a single-wall construction using the same materials. To counter the high water pressure forces on a hollow body at extreme depths the transfer sections (6) are preferably equipped with an inert gas injection system. An electronic logic signal derived from the hoisting means (1) and corresponding to the depth of the transfer sections (6) is provided to the inert gas injection system. The inert gas injection system modulates the release and control of a high-pressure inert gas that is injected into the double-wall sections of the transfer sections (6) creating in internal gas pressure substantially equal to the external water pressure. The substantially equal internal and external forces will mitigate the crushing forces of the high water pressure forces.

The transfer section hoisting means (1) is preferably a standard hoist or winch. The transfer section hoisting means (1) is used to lower the transfer sections (6) via a hoisting cable (2) into the sea along guide cables (16).

Figure 4:
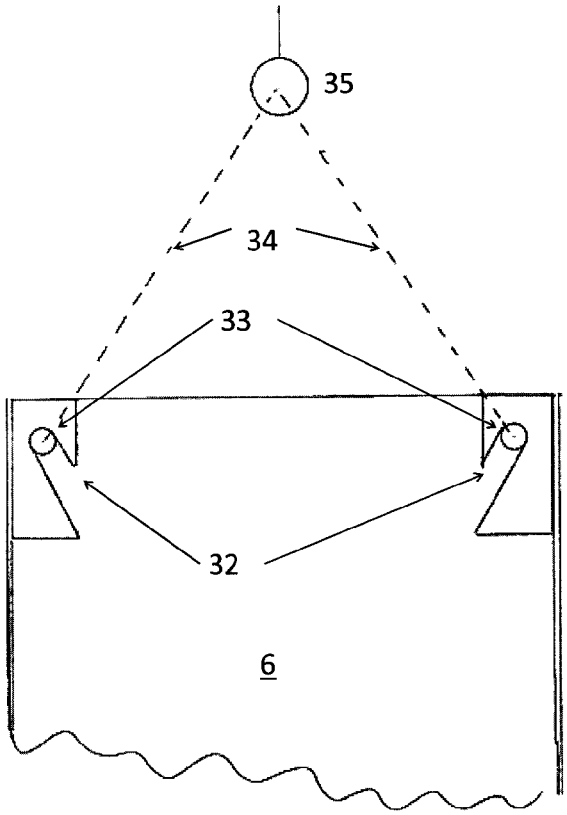
FIG. 4 shows a blown-up view of a proposed no-load release of a transfer pipe according to an embodiment of the present invention.
Figure 5:
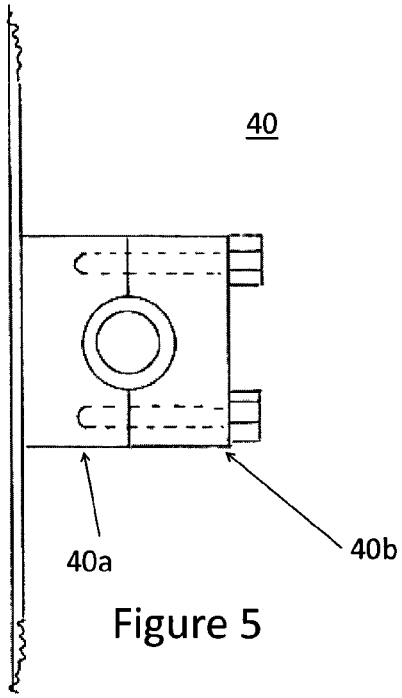
FIG. 5 shows a blown-up view of a proposed cable guiding ring system according to an embodiment of the present invention.

Preferably, the transfer sections (6) also have a 'no-load' or 'Gravity Release' release mechanism, such as the one depicted in FIG. 4. The preferred 'no-load' release mechanism comprises angled slots (32) located on opposing inner sides of a transfer tube (6) and a sling (35). The sling (35) is affixed to the end of the hoisting cable (2) and comprises two equal length release cables (34) each having a releasable bar (33) of appropriate size affixed to the end thereof. When each of the releasable bars (33) are fitted into a respective angled slot (32), and put under load, the releasable bars (33) are forced upwards into their respective angled slots (32), thus providing support for carrying a transfer section (6). Once the transfer sections (6) have been lowered into place and no-load exists, the releasable bars (33) fall out of their respective angle slot (32) and the sling can be returned to the surface for lowering the next transfer section (6). The releasable bars (33) may also be a standard hoisting hardware item such as an open hook.

The cable guiding rings (40) preferably comprises two portions, a first portion (40*a*) having a smooth semi-circle notch and is rigidly affixed to the transfer section (6), a second portion (40*b*) having a smooth semi-circle notch and can be releasably affixed to the first portion (40*a*) via fastening means. When the first portion (40*a*) and the second portion (40*b*) are fastened together the cable guiding ring (40) forms a circular hole that encircles a guiding cable (16). The cable guiding rings (40) provide for a secure attachment of the transfer sections (6) to the cable guides (16).

To provide for a more adaptable system the Subsea crude oil and/or gas recovery and trapping system and method preferably comprises an anchoring means (22) that is adjustable allowing it to fully enclose larger wellheads, or the system and method comprises multiple anchoring means (22) each of a different diameter such that the most appropriate size may be used. In an instance when a larger diameter anchoring means (22) is needed, a tapered transfer section (not shown) is provided to bridge the larger diameter anchoring means (22) to the preferred standard sized transfer sections. The taper of the tapered transfer section gives it a frustoconical shape.

The preferred number of number of guide cables (16) to be used is 4 circumferentially spaced at 90° apart. Accordingly, the number of guide cable hoisting means (8), guide cable reels (12), cable connectors (15), and the number of cable guiding rings (40) in a set would also be 4. However, more or less guide cables, and related features, are envisioned.

The transfer sections (6) and the tapered transfer section are preferably made of a strong and rigid material having the capability of resisting compressive forces, such as the water pressure forces and the forces of the stacked transfer sections (6) pushing down and capable of being used in a salt water environment. Preferably the transfer sections (6) and the tapered transfer section are made of hot-rolled plain carbon steel with a protective coating. Preferably the practice coating is rubber.

The guide cables (16) are preferably pre-lubricated 1" to 2" steel cable having high tensile strength.

Alignment of the stack of transfer sections and the connections between each of the transfer sections (6) are preferably made via the guide cables (16) and the joint connections are kept substantially sealed by the force of transfer sections (6) pushing down on previously lowered transfer sections (6). By not having each of the stacked transfer sections (6) affixed to each other in some manner allows the stack of transfer sections to be flexible between the sea floor and sea surface. The flexibility of the stack of transfer sections allows it to withstand tidal currents and wave-produced stresses. Additionally, in the event of excess pressure within the stack of transfer sections from a release of high pressure gas, for example, the excess pressure may be alleviated by an opening of a joint connection and possibly releasing some oil and/or gas mixture.

As is well known, the density of sea water ($\rho \approx 1022$ kg/m$^3$) is greater than the density of crude oil (see Table 1). As such, the deeper the wellhead is below sea level the greater the pressure difference between the inside of the transfer sections (6) containing mostly crude oil and/or gas and outside of the transfer sections (6) being sea water. If the pressure difference becomes too great the transfer sections may collapse. Accordingly, to lessen the pressure difference the transfer sections (6) may be provided with pressure balance ports (9) to allow sea water to also occupy the volume inside the transfer section system.

TABLE 1

| Crude Oil Type | | |
|---|---|---|
| API Gravity or Location | Temperature (° C.) | Density (kg/m$^3$) |
| Crude oil, 48° API | 15.5 | 790 |
| Crude oil, 40° API | 15.5 | 825 |
| Crude oil, 35.6° API | 15.5 | 847 |
| Crude oil, 32.6° API | 15.5 | 862 |
| Crude oil, California | 15.5 | 915 |
| Crude oil, Mexican | 15.5 | 973 |
| Crude oil, Texas | 15.5 | 873 |

The preferred configuration of the system on a modified or specifically designed vessel is described immediately below. The transfer section hoisting means (1) may be operable from a Deck Level 3 and would define a centre line for lowering the transfer sections (6) and allow for vertical orientation of transfer sections (6). The transfer sections (6) may also be stored on Deck Level 3. The guide cable hoisting means (8) and guide cable reels (12) may be located on Deck Level 2 and are positioned to have a centre line equal to the centre line of transfer section hoisting means (1). However, other configurations are envisioned.

A method of deploying the system outlined above will now be described.

The location of the leaking wellhead on the seabed is located via a locating means, such as the global positioning system or a remote controlled submersible. Determination of the size of the wellhead is acquired in order to choose an appropriately sized anchoring means (22) or to adjust the size of an adjustable anchoring means.

The anchoring means (22) is then lowered to the seabed encircling the wellhead within the anchoring means (22). The anchoring means (22) is lowered via the guide cable hoisting means (8), when lowering the anchoring means (22) the guide cable hoisting means (8) are in synchronous operation to ensure that the anchoring means (22) remains substantially level with the seabed surrounding the wellhead that the anchoring means (22) will be anchored upon. After the anchoring means (22) is anchored in position the guide cable hoisting means (8) will operate independently of each other ensuring that the guide cables (16) remain in tension via a load control system at all times and would respond to tides or other tidal movement.

After the anchoring means (22) is anchored in place, the first standard sized transfer section (6) or the tapered transfer section (if a larger or adjusted size anchoring means is used) is prepared for lowering. The releasable bars (33) of the sling (35) are placed in their respective angled slot (32) and placed under load over the vessel exit shaft (25), the guide cables (16)

are secured in the cable guiding rings (40) and the transfer section (6) is lowered until it comes to rest on the anchoring means (22).

Subsequent transfer sections (6) are then lowered in a similar manner until a series of transfer sections (6) are stacked to reach the surface. The leaking crude oil and/or gas is now being contained and directed to the sea surface in a more controlled fashion for capture and processing.

The crude oil and/or gas may be recovered and/or capture for processing by any means currently known in the art.

To provide for a faster reaction time the subsea crude oil and/or gas containment and recovery system may be installed prior to a leak.

The foregoing are exemplary embodiments of the present invention and a person skilled in the art would appreciate that modifications to these embodiments may be made without departing from the scope and spirit of the invention.

INDUSTRIAL APPLICABILITY

The present invention is applicable to offshore drilling industries for minimizing the environmental effects of leaking crude oil and/or gas from a wellhead on the seabed by containing and directing the leaking crude oil and/or gas to a specific spot on the sea surface for recovery.

The embodiments of the present invention in which an exclusive property or privilege is claimed are defined as follows:

1. A subsea crude oil and/or gas containment and recovery system comprising:

an anchoring means defining a top side and a bottom side for providing a stable support structure for the subsea crude oil and/or gas containment and recovery system;

at least one guide cable releasably affixed to the anchoring means via at least one guide cable connector for orienting and/or aligning and supporting the subsea crude oil and/or gas containment and recovery system;

at least one guide cable hoisting means for lowering the anchoring means via the at least one guide cable;

a plurality of transfer sections releaseably and slideably connected to the at least one guide cable via at least one cable guiding ring for containing and directing crude oil and/or gas from a wellhead or a crude oil and/or gas leak on a seabed floor; and a transfer section hoisting means for lowering the plurality of transfer sections along the at least one guide cable via a hoisting cable.

2. The subsea crude oil and/or gas containment and recovery system according to claim 1:

wherein the anchoring means is a substantially heavy annular ring shaped and dimensioned to encircle the wellhead or the crude oil and/or gas leak on the seabed floor.

3. The subsea crude oil and/or gas containment and recovery system according to claim 2:

wherein the anchoring means has a rigidly affixed annular ring with a base gasket on the top side thereof and an inner diameter of the annular ring is shaped and dimensioned so as to accommodate an outer diameter of one of the plurality of transfer sections for providing a connecting means to one of the plurality of transfer sections.

4. The subsea crude oil and/or gas containment and recovery system according to claim 1:

wherein the anchoring means has protrusions on the bottom side thereof so as to inhibit lateral movement when in an anchoring position.

5. The subsea crude oil and/or gas containment and recovery system according to claim 1:

wherein the at least one guide cable is stored on at least one guide cable reel.

6. The subsea crude oil and/or gas containment and recovery system according to claim 1:

wherein the at least one guide cable is of sufficient length to at least reach the seabed floor.

7. The subsea crude oil and/or gas containment and recovery system according to claim 1:

wherein the plurality of transfer sections are elongated hollow tubes each having a flange at each end thereof.

8. The subsea crude oil and/or gas containment and recovery system according to claim 7:

wherein at least one of the plurality of transfer sections is frustoconical in shape.

9. The subsea crude oil and/or gas containment and recovery system according to claim 1:

wherein the plurality of transfer sections are elongated conduits each having a flange at each end thereof.

10. The subsea crude oil and/or gas containment and recovery system according to claim 1:

wherein the plurality of transfer sections are of an enclosed hollow double-wall construction.

11. The subsea crude oil and/or gas containment and recovery system according to claim 10:

wherein each of the plurality of transfer sections are equipped with an inert gas injection system.

12. The subsea crude oil and/or gas containment and recovery system according to claim 1:

wherein the transfer section hoisting means is a hoist or a winch.

13. The subsea crude oil and/or gas containment and recovery system according to claim 1:

wherein each of the plurality of transfer sections has a gravity release mechanism.

14. The subsea crude oil and/or gas containment and recovery system according to claim 1:

wherein the anchoring means has an adjustable diameter.

15. The subsea crude oil and/or gas containment and recovery system according to claim 1:

wherein the plurality of transfer sections are made of a strong and rigid material capable of resisting compressive forces.

16. The subsea crude oil and/or gas containment and recovery system according to claim 15:

wherein the strong and rigid material is hot-rolled plain carbon steel having a protective coating.

17. The subsea crude oil and/or gas containment and recovery system according to claim 1:

wherein the at least one guide cable is made of pre-lubricated 1" to 2" steel cable having high a tensile strength.

18. The subsea crude oil and/or gas containment and recovery system according to claim 1:

wherein the plurality of transfer sections have pressure balance ports.

19. The subsea crude oil and/or gas containment and recovery system according to claim 1:

wherein the subsea crude oil and/or gas containment and recovery system is installed on a modified or a specifically designed vessel.

20. A method of deploying a subsea crude oil and/or gas containment and recovery system comprising the steps of:

locating a location of a wellhead or a crude oil and/or gas leak on a seabed floor via a locating means;

lowering an anchoring means in a substantially level manner with respect to the seabed floor to the seabed floor encircling the wellhead or the crude oil and/or gas leak via at least one guide cable hoisting means and at least one guide cable into an anchoring position;

tensioning the at least one guide cable via a load control system controlling the at least one guide cable hoisting means;

securing a transfer section to the at least one guide cable via at least one guide cable connector;

lowering the transfer section via a transfer section hoisting means along the at least one guide cable until it comes to rest on the anchoring means;

securing and lowering subsequent transfer sections until a substantially vertical column of transfer sections are stacked to reach a sea surface;

recovering the crude oil and/or gas from the wellhead or the crude oil and/or gas leak that is being contained and directed to the sea surface by the substantially vertical column of transfer sections.

* * * * *